US008165500B2

(12) United States Patent
Kamiya et al.

(10) Patent No.: US 8,165,500 B2
(45) Date of Patent: Apr. 24, 2012

(54) FIXING DEVICE AND IMAGE FORMING APPARATUS

(75) Inventors: Shogo Kamiya, Ebina (JP); Toshinori Sasaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 90 days.

(21) Appl. No.: 12/840,711

(22) Filed: Jul. 21, 2010

(65) Prior Publication Data

US 2011/0135341 A1 Jun. 9, 2011

(30) Foreign Application Priority Data

Dec. 9, 2009 (JP) ..... 2009-279502

(51) Int. Cl.
*G03G 15/16* (2006.01)

(52) U.S. Cl. ..... 399/122

(58) Field of Classification Search ..... 399/33, 399/67, 122, 320, 307, 322, 327, 400, 329
See application file for complete search history.

(56) References Cited

U.S. PATENT DOCUMENTS 7,454,157 B2 * 11/2008 Yamada et al. ..... 399/116
8,023,861 B2 * 9/2011 Yoshinaga et al. ..... 399/122

FOREIGN PATENT DOCUMENTS

JP 2003-005566 A 1/2003

* cited by examiner

*Primary Examiner* — Kiho Kim
(74) *Attorney, Agent, or Firm* — Sughrue Mion, PLLC

(57) ABSTRACT

A fixing device includes: a belt unit that includes a first roller member, a second roller member provided above the first roller member, a belt member rotating while laid around these roller members, and a positioning member rotatably holding the first roller member and used for positioning the first roller member; a pressure member provided below the first roller member and coming into pressure-contact with an outer peripheral surface of the belt member at a position where the pressure member faces the first roller member, thereby to form a fixing pressure portion; a first housing that supports the positioning member and includes a concave portion opening toward a lateral direction and a sloping portion sloping downward from a lower edge portion of the concave portion; and a second housing pressing the positioning member to fit into the concave portion, along with a closing operation with respect to the first housing.

11 Claims, 6 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Application No. 2009-279502 filed Dec. 9, 2009.

BACKGROUND

1. Technical Field

The present invention relates to a fixing device and an image forming apparatus that fixes an unfixed toner image on a recording medium.

2. Related Art

As a fixing device used for an image forming apparatus of a copying machine or a printer, one such device having a heating member constituted by a belt member (a fixing belt) provided with tension by plural rollers is known.

SUMMARY

According to an aspect of the present invention, there is provided a fixing device including: a belt unit that includes a first roller member, a second roller member provided above the first roller member, a belt member rotating while being laid around the first roller member and the second roller member, and a positioning member rotatably holding the first roller member and being used for positioning of the first roller member; a pressure member that is provided below the first roller member and comes into pressure-contact with an outer peripheral surface of the belt member at a position where the pressure member faces the first roller member, thereby to form a fixing pressure portion between the pressure member and the belt member, the fixing pressure portion allowing a recording medium carrying an unfixed toner image to pass therethrough; a first housing that includes a concave portion and a sloping portion formed therein and supports the positioning member, the concave portion opening toward a lateral direction, the sloping portion sloping downward from an edge portion of a lower side of the concave portion; and a second housing that presses the positioning member so that the positioning member is fitted into the concave portion, in accordance with a closing operation to move in a direction in which the second housing is closed with respect to the first housing.

BRIEF DESCRIPTION OF THE DRAWINGS

Exemplary embodiment of the present invention will be described in detail based on the following figures, wherein.

DETAILED DESCRIPTION

An exemplary embodiment of the present invention is described below in detail with reference to the accompanying drawings.

<Explanation of Image Forming Apparatus>

Figure 1:
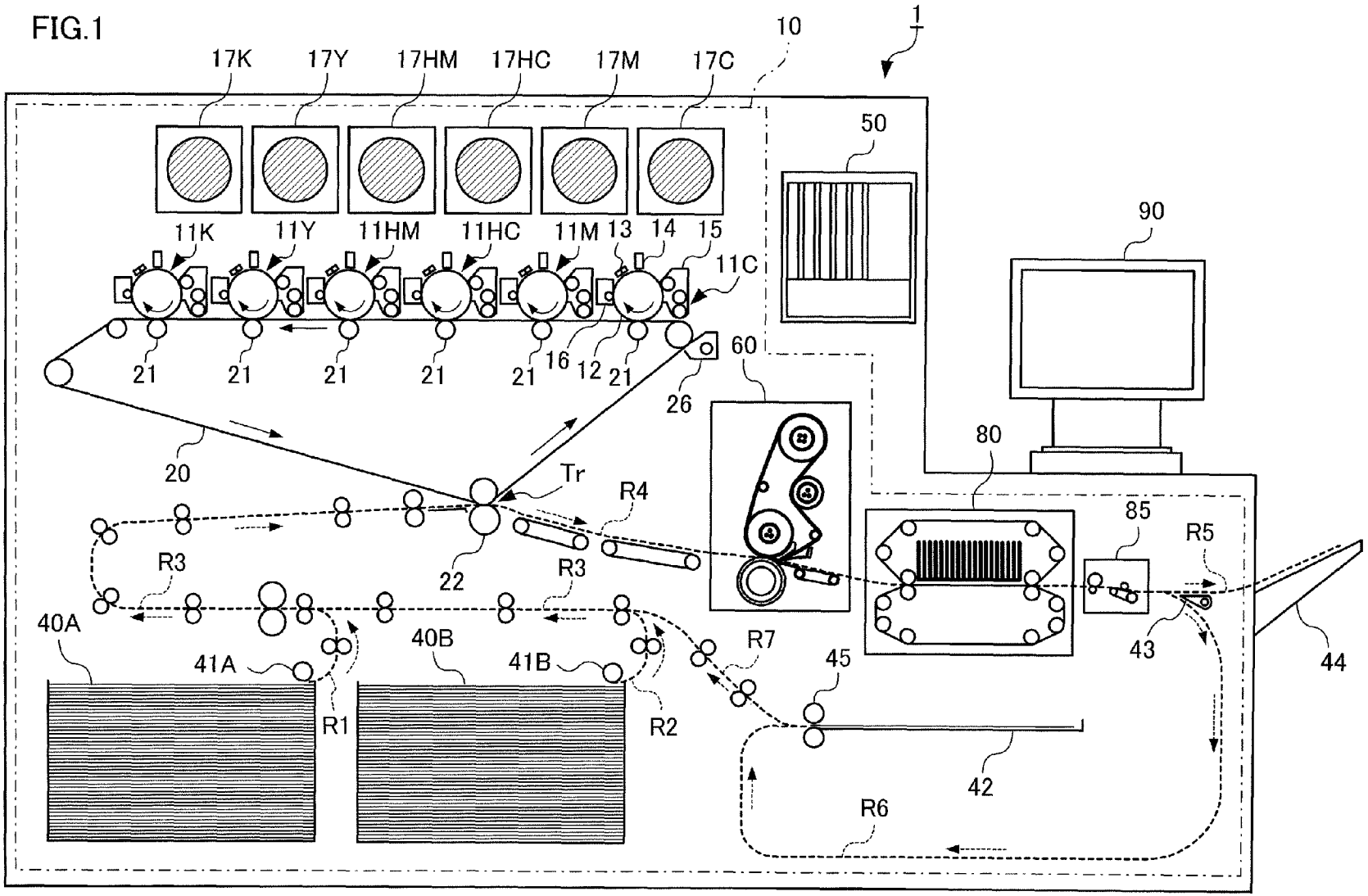
FIG. 1 is a diagram showing a configuration example of an image forming apparatus to which a fixing device according to the exemplary embodiment is applied.

FIG. 1 is a diagram showing a configuration example of an image forming apparatus 1 to which a fixing device (fixing unit) 60 according to the present exemplary embodiment is applied. The image forming apparatus 1 shown in FIG. 1 is a so-called "tandem-type" color printer, and includes: an image forming portion 10 which forms an image on the basis of image data; a main controller 50 which controls operations of the entire image forming apparatus 1, performs communications with a personal computer (PC) and performs image processing on image data and the like, for example; and a user interface (UI) unit 90 which accepts an input operation made by the user and displays various information for the user.

<Explanation of Image Forming Portion>

The image forming portion 10, which is an example of a toner image forming unit, is a functional portion which forms an image through an electrophotographic system for example, and includes six image forming units 11C, 11M, 11HC, 11HM, 11Y, and 11K (hereinafter, also referred to as "image forming units 11" collectively), which are arranged in parallel. For example, each of the image forming units 11 includes, as functional members: a photoconductive drum 12 on which an electrostatic latent image is formed and thereafter a toner image of each color is formed; a charging device 13 which charges the surface of the photoconductive drum 12 at a predetermined electric potential; an exposure device 14 which exposes the photoconductive drum 12 on the basis of image data, the photoconductive drum 12 charged by the charging device 13; a developing device 15 which develops the electrostatic latent image formed on the photoconductive drum 12 by using a toner of each color; and a cleaner 16 which cleans the surface of the photoconductive drum 12 after transfer.

The developing devices 15 of the respective image forming units 11 are connected through toner transport paths (not shown) to toner containers 17C, 17M, 17HC, 17HM, 17Y, and 17K (hereinafter, also referred to as "toner containers 17" collectively), and are configured to be refilled with color toners from the toner containers 17 through refill screws (not shown) provided in the toner transport paths. Here, the toner containers 17 store the respective color toners.

The image forming units 11 have similar configurations except toners housed in the respective developing devices 15, and form toner images of the respective colors of cyan (C), magenta (M), high-saturation cyan (HC), high-saturation magenta (HM), yellow (Y) and black (K). Here, HC has a hue of cyan, and has a light color tone and high saturation relative to those of C. HM has a hue of magenta, and has a light color tone and high saturation relative to those of M.

The image forming portion 10 also includes: an intermediate transfer belt 20 on which the color toner images formed on the photoconductive drums 12 of the respective image forming units 11 are transferred; primary-transfer rollers 21 which transfer (primary-transfer) the color toner images on the intermediate transfer belt 20, the color toner images being formed by the image forming units 11; a secondary-transfer roller 22 which collectively transfers (secondary-transfers), to a sheet that is a recording medium (recording sheet), the color toner images transferred on the intermediate transfer belt 20 in a superimposing manner; and the fixing unit 60 as an example of a fixing unit (fixing device) which fixes the secondary-transferred color toner images on the sheet.

In addition, the image forming portion 10 includes: a cooling unit 80 which cools the color toner images fixed on the sheet by the fixing unit 60 so as to facilitate the fixing of the color toner images on the sheet; and a curl correcting unit 85 which corrects curl of the sheet.

Note that, in the image forming apparatus 1 of the present exemplary embodiment, the intermediate transfer belt 20, the primary-transfer rollers 21 and the secondary-transfer roller 22 constitute a transfer unit. Further, hereinafter, a region in which the secondary-transfer roller 22 is placed to secondary-transfer the color toner images, which have been transferred on the intermediate transfer belt 20, onto the sheet will be referred to as "secondary-transfer region Tr."

<Explanation of Sheet Transporting System>

The image forming portion 10 also includes, as a sheet transporting system: multiple (two in the present exemplary embodiment) sheet containers 40A and 40B which house sheets therein; feed rollers 41A and 41B which feed and transport sheets housed in the sheet containers 40A and 40B; a first transport path R1 which is used for transporting a sheet fed from the sheet container 40A; a second transport path R2 which is used for transporting a sheet fed from the sheet container 40B; a third transport path R3 which is used for transporting the sheet fed from the sheet container 40A or 40B toward the secondary-transfer region Tr; a fourth transport path R4 which is used for transporting the sheet, on which the color toner images are transferred in the secondary-transfer region Tr, so as to cause the sheet to pass through the fixing unit 60, the cooling unit 80 and the curl correcting unit 85; and a fifth transport path R5 which is used for transporting the sheet from the curl correcting unit 85 toward a sheet stacking unit 44 provided to an output portion of the image forming apparatus 1.

Transport rollers or transport belts are arranged on each of the first to fifth transport paths R1 to R5 to sequentially transport sheets fed on their corresponding path.

<Explanation of Duplex Transporting System>

The image forming portion 10 also includes, as a duplex transporting system: an intermediate sheet container 42 which once holds a sheet on a first surface of which the color toner images are fixed by the fixing unit 60; a sixth transport path R6 which is used for transporting a sheet from the curl correcting unit 85 toward the intermediate sheet container 42; a seventh transport path R7 which is used for transporting a sheet housed in the intermediate sheet container 42 toward the third transport path R3; a routing mechanism 43 which is arranged downstream of the curl correcting unit 85 in a sheet transport direction, and selects the route of a sheet between the fifth transport path R5 and the sixth transport path R6, the fifth transport path R5 used for transporting the sheet toward the sheet stacking unit 44, the sixth transport path R6 used for transporting the sheet toward the intermediate sheet container 42; feed rollers 45 which feed a sheet housed in the intermediate sheet container 42 and transport the sheet toward the seventh transport path R7.

<Explanation of Image Forming Operation>

Next, a basic image forming operation performed by the image forming apparatus 1 according to the present exemplary embodiment is described.

The image forming units 11 of the image forming portion 10 form toner images of the respective colors of C, M, HC, HM, Y and K with an electrophotographic process using the functional members described above. The color toner images formed by the respective image forming units 11 are primary-transferred on the intermediate transfer belt 20 sequentially by the primary-transfer rollers 21, so that a combined toner image in which the color toners are superimposed is formed. With the movement of the intermediate transfer belt 20 (in its arrow direction), the combined toner image on the intermediate transfer belt 20 is transported to the secondary-transfer region Tr in which the secondary-transfer roller 22 is arranged.

Meanwhile, in the sheet transporting system, the feed rollers 41A and 41B rotate in concert with the start timing of the image forming operation performed by the image forming units 11. Thus, one of sheets in the sheet container 40A or 40B is fed by the corresponding feed roller 41. Here, the selection between the sheet containers 40A and 40B is made through the UI unit 90, for example. The sheet fed by the feed roller 41A or 41B is transported to the secondary-transfer region Tr along the first transport path R1 or the second transport path R2, and the third transport path R3.

In the secondary-transfer region Tr, the combined toner image held on the intermediate transfer belt 20 is secondary-transferred on the sheet collectively with a transfer electric field formed by the secondary-transfer roller 22.

The sheet on which the combined toner image is transferred is thereafter separated from the intermediate transfer belt 20, and transported to the fixing unit 60 along the fourth transport path R4. The fixing unit 60 performs a fixing process on the combined toner image formed on the sheet transported thereto, and thereby fixes the toner image on the sheet. The sheet having the fixed image formed thereon is then cooled by the cooling unit 80, and its curl is corrected by the curl correcting unit 85. The sheet having passed through the curl correcting unit 85 is thereafter routed by the routing mechanism 43. In the case of simplex printing, the sheet is guided to the fifth transport path R5 so as to be transported toward the sheet stacking unit 44.

Note that, the toner attached to each photoconductive drum 12 after the primary-transfer (primary-transfer residual toner) is removed by the corresponding cleaner 16, and the toner attached to the intermediate transfer belt 20 after the secondary-transfer (secondary-transfer residual toner) is removed by a belt cleaner 26.

In the case of duplex printing, the sheet, on the first surface of which the fixed image is formed through the aforementioned process, passes through the curl correcting unit 85 and is then guided by the routing mechanism 43 to the sixth transport path R6 so as to be transported toward the intermediate sheet container 42. Then, the feed rollers 45 rotate in concert with the start timing of an image forming operation for a second surface performed by the image forming units 11, and the sheet is thereby fed from the intermediate sheet container 42. The sheet fed by the feed rollers 45 is transported to the secondary-transfer region Tr along the seventh and third transport paths R7 and R3.

In the secondary-transfer region Tr, as in the case of the operation for the first surface, color toner images for the second surface which are held on the intermediate transfer belt 20 are secondary-transferred on the sheet collectively with a transfer electric field formed by the secondary-transfer roller 22.

The sheet, both surfaces of which the toner images are formed, is subjected to the fixing process by the fixing unit 60, cooled by the cooling unit 80, and its curl is corrected by the curl correcting unit 85, as in the case of the operation for the first surface. The sheet having passed through the curl correcting unit 85 is then guided by the routing mechanism 43 to the fifth transport path R5 so as to be transported toward the sheet stacking unit 44.

The image forming process of the image forming apparatus 1 is repeatedly performed in the aforementioned manner until cycles corresponding to the number of sheets to be printed have elapsed.

<Explanation of Configuration of Fixing Unit>

Next, the fixing unit 60 employed in the image forming apparatus 1 according to the present exemplary embodiment is described.

Figure 2:
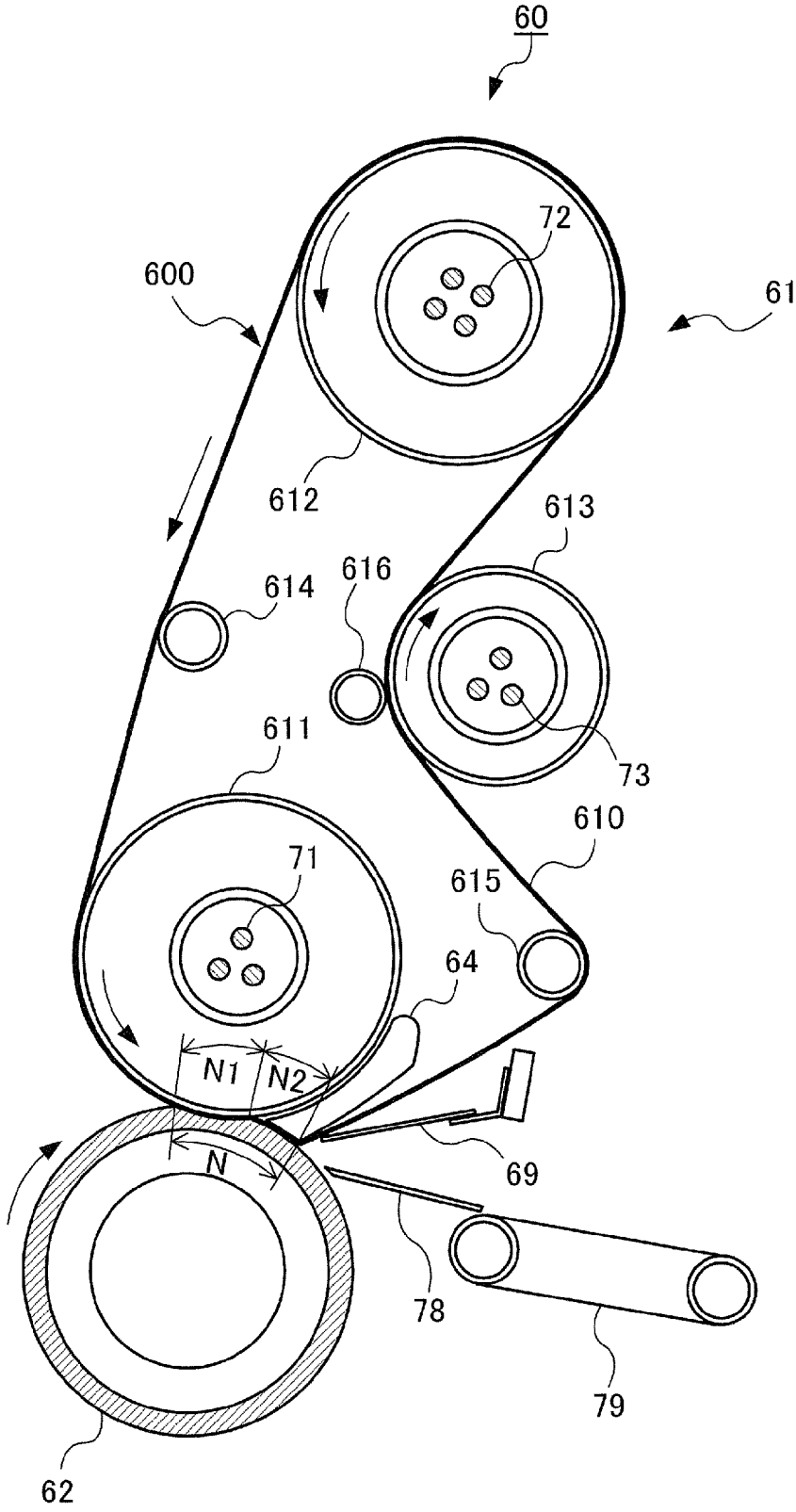
FIG. 2 is a sectional configuration diagram for illustrating a configuration of the fixing unit.

FIG. 2 is a sectional configuration diagram for illustrating a configuration of the fixing unit 60 according to the present exemplary embodiment. The fixing unit 60 is mainly formed of: a fixing belt module 61 heating a sheet; an outer heating roller 613 as an example of an outer heating member which heats a fixing belt 610 provided to the fixing belt module 61, while tensioning the fixing belt 610 from the outer side thereof; and a pressure roller 62 as an example of a pressure member which is configured in such a way that the pressure roller 62 may come into contact with and separate from the fixing belt module 61.

The fixing belt module 61 includes: the fixing belt 610 as an example of a belt member which moves circularly; a fixing roller 611 as an example of a first roller member which rotates while tensioning the fixing belt 610, and heats the fixing belt 610 from the inner side thereof at a nip portion N as an example of a fixing pressure portion that is a region where the fixing belt module 61 and the pressure roller 62 are in pressure-contact with each other (i.e., in contact with each other while pressing each other); an inner heating roller 612 as an example of a second roller member which heats the fixing belt 610 while tensioning the fixing belt 610 from the inner side thereof. Additionally, the fixing belt module 61 includes: a tension roller 614 which tensions the fixing belt 610 between the fixing roller 611 and the inner heating roller 612 (i.e., at the upstream side of the nip portion N in a belt movement direction); a peeling pad 64 as an example of a peeling member which is arranged downstream of the nip portion N in the belt movement direction and near the fixing roller 611; a tension roller 615 which tensions the fixing belt 610 between the nip portion N and the outer heating roller 613 (at the downstream side of the nip portion N in the belt movement direction); and a support roller 616 which supports the fixing belt 610 while receiving pressing force from the outer heating roller 613.

The fixing belt 610 is formed of: a base layer which is made of polyimide resin; an elastic body layer which is stacked on the surface (outer peripheral surface) of the base layer and made of silicone rubber; and a release layer which covers the elastic body layer and is made of PFA (tetrafluoroethylene-perfluoroalkyl vinyl ether copolymer resin), for example. Here, the elastic body layer is provided for improving quality of color images in particular. To be more specific, the elastic body layer is provided for the following reason. A toner image held on the sheet on which the toner image is to be fixed is formed by stacking powdery color toners. Accordingly, in order to uniformly heat the entire toner image at the nip portion N, the front surface of the fixing belt 610 may be deformed to follow the surface irregularities of the toner image on the sheet.

The fixing roller 611 is a cylindrical roller made of aluminum or SUS, for example. The fixing roller 611 is rotated in its arrow direction in FIG. 2 by the rotational driving force of an unillustrated driving motor, and heated to a predetermined temperature (150° C., for example) by three halogen heaters 71, for example, as an example of a heat source placed inside the fixing roller 611.

The inner heating roller 612 is a cylindrical roller made of aluminum or SUS, for example. The inner heating roller 612 is heated to a predetermined temperature (190° C., for example) by four halogen heaters 72, for example, as an example of a heat source placed inside the inner heating roller 612.

Moreover, a spring member (not shown) is arranged at both end portions of the inner heating roller 612. The spring member presses the fixing belt 610 from the inner side thereof, and thereby sets the tension of the entire fixing belt 610 at, for example, 15 kgf.

The inner heating roller 612 is further provided with a mechanism (not shown) for controlling the meandering (belt walk) of the fixing belt 610.

The peeling pad 64 is a block member formed of metal such as SUS or resin, for example, and having an arc-shaped cross section. The peeling pad 64 is fixedly arranged over the entire area of the fixing roller 611 in its axial direction at a position downstream of a region where the pressure roller 62 is to come into pressure-contact with the fixing roller 611 with the fixing belt 610 interposed therebetween (such a region is hereinafter called a "roller nip portion N1"). The peeling pad 64 is arranged to uniformly press, at a predetermined load (at an average of 10 kgf, for example), the pressure roller 62 in a predetermined width region (over a nip width of 5 mm in the movement direction of the fixing belt 610, for example) with the fixing belt 610 interposed therebetween. Such a width region forms a "peeling pad nip portion N2" adjacent to the roller nip portion N1.

The outer heating roller 613 has its base made of aluminum or SUS, for example, and is a cylindrical roller formed by a surface thereof being subjected to nitriding, for example. The outer heating roller 613 is heated to a predetermined temperature (190° C., for example) by three halogen heaters 73, for example, placed inside the outer heating roller 613.

As described above, the fixing unit 60 of the present exemplary embodiment employs a configuration in which the fixing belt 610 is heated by the fixing roller 611, the inner heating roller 612 and the outer heating roller 613.

Note that, in the fixing belt module 61, the fixing belt 610, the fixing roller 611, the inner heating roller 612, the tension roller 614, the tension roller 615, the support roller 616 and the peeling pad 64 except the outer heating roller 613 configure a belt unit 600 provided to the image forming apparatus 1 so as to be attachable and detachable. Detail of the belt unit 600 will be described later.

The pressure roller 62 has, as its base, a cylindrical roller made of aluminum or SUS, for example, and has an elastic layer made of silicone rubber, and a release layer made of a PFA tube which are stacked in this order from the base side. The pressure roller 62 is arranged in such a way that it may come into contact with and separate from the fixing belt module 61. When the pressure roller 62 is in contact with the fixing belt module 61 while pressing the fixing belt module 61 (i.e., in pressure-contact therewith), the pressure roller 62 is rotated with the rotation of the fixing roller 611 of the fixing belt module 61 in its arrow direction.

<Explanation of Fixing Operation Performed by Fixing Unit>

Next, a fixing operation performed by the fixing unit 60 of the present exemplary embodiment is described.

In the image forming apparatus 1, a combined toner image (unfixed toner image) is electrostatically transferred on the sheet in the secondary-transfer region Tr (see FIG. 1), and the sheet is then transported toward the nip portion N (see FIG. 2) of the fixing unit 60 along the fourth transport path R4 (see FIG. 1). When the sheet passes through the nip portion N, the unfixed toner image on the sheet is fixed on the sheet mainly by pressure and heat acting on the roller nip portion N1.

To be more specific, in the fixing unit 60 of the present exemplary embodiment, heat to act on the roller nip portion N1 is supplied mainly through the fixing belt 610. The fixing belt 610 is heated by: heat supplied by the halogen heaters 71 placed inside of the fixing roller 611 through the fixing roller 611; heat supplied by the halogen heaters 72 placed inside of the inner heating roller 612 through the inner heating roller 612; and heat supplied by the halogen heaters 73 placed inside of the outer heating roller 613 through the outer heating roller 613. This configuration allows thermal energy to be supplied not only through the fixing roller 611 but also through the inner heating roller 612 and the outer heating roller 613. Accordingly, a sufficient amount of heat supply is secured in the roller nip portion N1 even at a high process speed.

In the fixing unit 60 of the present exemplary embodiment, the fixing belt 610 serving as a direct fixing member may have a configuration with extremely low heat capacity. In addition, the fixing belt 610 is configured to be in contact with each of the fixing roller 611, the inner heating roller 612, and the outer heating roller 613, which are heat supplying members, in a large wrap area (wrap angle). This configuration allows a sufficient amount of heat to be supplied through the fixing roller 611, the inner heating roller 612, and the outer heating roller 613 in a short period in which the fixing belt 610 makes one rotation, and thereby allows the fixing belt 610 to come back to a required fixing temperature within a short time period. Hence, the predetermined fixing temperature is maintained in the roller nip portion N1.

As a consequence, with the fixing unit 60 of the present exemplary embodiment, a fixing temperature is maintained within a certain range even when sheets are continuously fed at a high speed. Moreover, a phenomenon in which the fixing temperature drops at the start of high-speed fixing operation (so-called a "temperature droop phenomenon") is suppressed. These effects of the maintenance of the fixing temperature and the suppression of the temperature droop phenomenon also hold for the fixing operation especially on heavy paper or the like having high heat capacity. Further, even if the fixing temperature needs to be changed (including both increase and decrease of the fixing temperature) halfway through a printing operation in accordance with types of sheets, such a temperature change is easily performed by adjusting the outputs of the halogen heaters 71 to 73 owing to the low heat capacity of the fixing belt 610.

Further, in the fixing unit 60 of the present exemplary embodiment, the fixing roller 611 is a hard roller made of aluminum, SUS, or the like, while the pressure roller 62 is a soft roller made by covering the elastic layer. Accordingly, in the roller nip portion N1, a nip region having a certain width in the movement direction of the fixing belt 610 is formed by the pressure roller 62 being bent at its surface with the fixing roller 611 being hardly bent. As described above, in the roller nip portion N1, the fixing roller 611 around which the fixing belt 610 is wound is hardly deformed. This allows the fixing belt 610 to pass through the roller nip portion N1 while fluctuation of moving speed of the fixing belt 610 is suppressed, and thereby restrains wrinkles and deformation from occurring in the fixing belt 610 at the roller nip portion N1. As a result, fixed images with good quality are stably provided.

After passing through the roller nip portion N1, the sheet is subsequently transported to the peeling pad nip portion N2. At the peeling pad nip portion N2, the pressure roller 62 presses the peeling pad 64, and thereby comes into pressure-contact with the fixing belt 610. Such a configuration causes the peeling pad nip portion N2 to have curving upward with the curvature of the pressure roller 62, while the roller nip portion N1 has a shape curving downward with the curvature of the fixing roller 611.

Due to the above configuration, the sheet, which has been heated and pressurized with the curvature of the fixing roller 611 in the roller nip portion N1, is caused to change its movement direction in the peeling pad nip portion N2 along the curvature of the pressure roller 62, which is opposite to the current direction. In this event, an extremely little slippage occurs between the toner image on the sheet and the surface of the fixing belt 610. This weakens the adhesion force between the toner image and the fixing belt 610, and thereby makes the sheet likely to be peeled from the fixing belt 610. In this way, the peeling pad nip portion N2 may be regarded as a region where a preparation step is carried out for ensuring reliable peeling in a final peeling step.

Since the fixing belt 610 is transported so as to be wound around the peeling pad 64 at the exit of the peeling pad nip portion N2, the transport direction of the fixing belt 610 is changed there. In other words, since the fixing belt 610 moves along the outer side surface of the peeling pad 64, the fixing belt 610 is bent to a large extent at the exit of the peeling pad nip portion N2. For this reason, the sheet, whose adhesion force to the fixing belt 610 has been weakened in advance in the peeling pad nip portion N2, is peeled from the fixing belt 610 by the stiffness of the sheet itself.

The sheet having been peeled from the fixing belt 610 is then moved in a direction guided by a peeling guide plate 69 which is arranged downstream of the peeling pad nip portion N2. The sheet having been guided by the peeling guide plate 69 is thereafter transported toward the cooling unit 80 by a sheet exit guide 78 and a sheet exit belt 79. The fixing process in the fixing unit 60 is completed with the above-described operation.

<Explanation of Configuration of Belt Unit>

Figure 3:
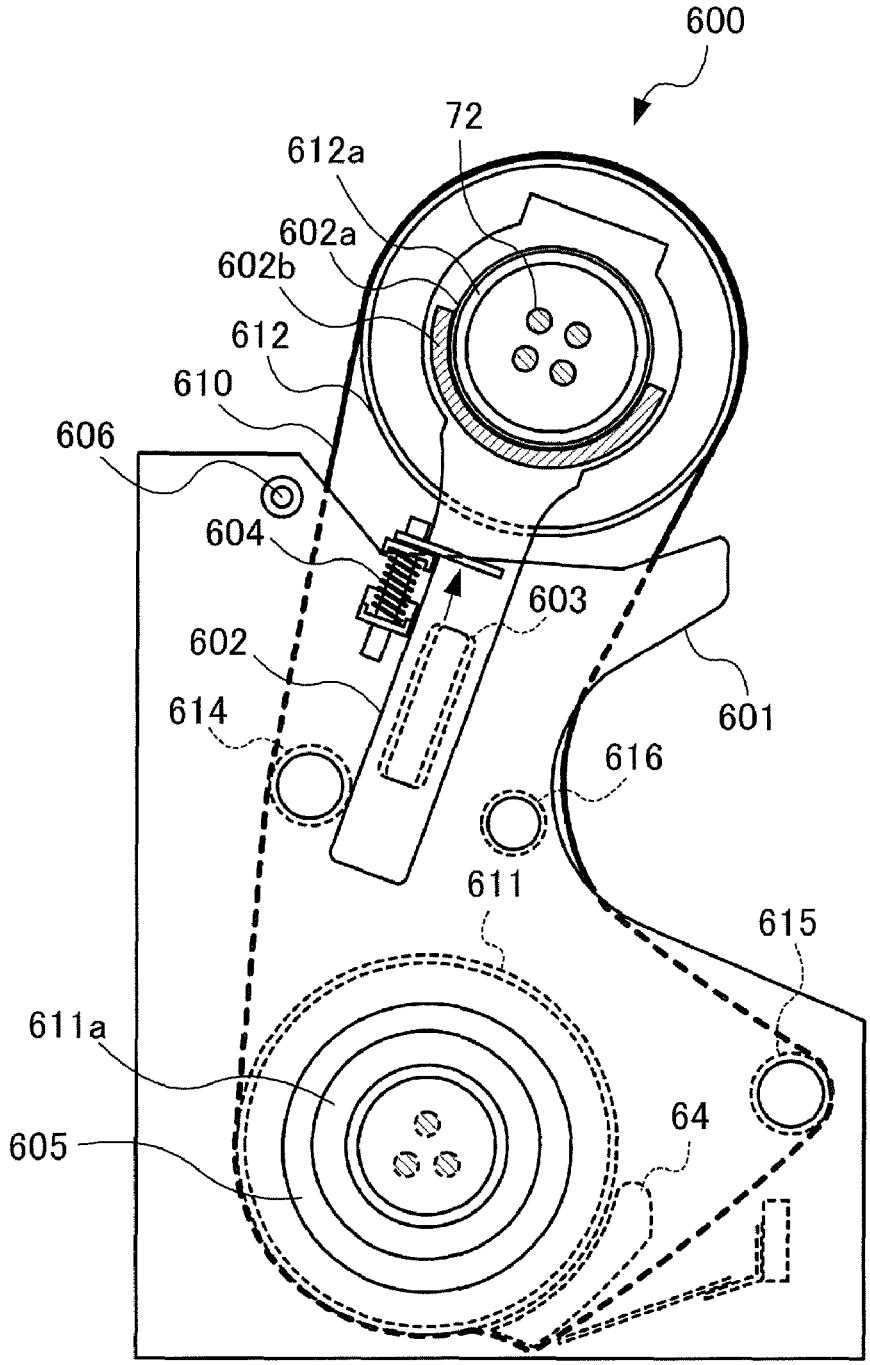
FIG. 3 is a diagram for illustrating a configuration of the belt unit in the fixing unit.

FIG. 3 is a diagram for illustrating a configuration of the belt unit 600 in the fixing unit 60. Note that FIG. 3 shows a side elevational view of the belt unit 600 seen from the front side thereof in FIG. 1.

The belt unit 600 includes: a support housing 601 which is formed of metal, such as SUS, rotatably supports roller members, such as the fixing roller 611, the tension roller 614, the tension roller 615 and the support roller 616, and supports members, such as the peeling pad 64, in a fixed state; and a roller support member 602 which is formed of metal, such as SUS, rotatably supports the inner heating roller 612. Here, the roller support member 602 is supported by a slide support member 603 arranged between the support housing 601 and the roller support member 602 so as to slide (move in parallel) in the direction of a rotation axis 612*a* of the inner heating roller 612. Additionally, the roller support member 602 supports the rotation axis 612*a* of the inner heating roller 612 by using a roller support portion 602*a*. This configuration allows the inner heating roller 612 to rotate through a bearing (not shown) arranged between the inner heating roller 612 and the rotation axis 612*a* supported by the roller support portion 602*a*.

Here, the roller support portion 602*a* supporting the rotation axis 612*a* of the inner heating roller 612 is provided with a low friction portion 602*b* made of a low friction member such as PFA, for example, which lowers sliding resistance between the rotation axis 612*a* and the roller support portion 602*a*.

In addition, the support housing 601 includes a roller biasing member 604 attached thereto. The roller biasing member 604 biases the roller support member 602 toward the rotation axis 612*a* of the inner heating roller 612. The roller biasing member 604 applies force toward an outer side (upward in FIG. 3) to the inner heating roller 612 with the roller support member 602 interposed therebetween, and thereby sets predetermined tension to the fixing belt 610 which tensions the inner heating roller 612.

Further, a rotation axis 611*a* of the fixing roller 611 is arranged in such a way that the rotation axis 611*a* penetrates a bore provided to the support housing 601 to project into the front side of the support housing 601 in FIG. 3. Additionally, an unillustrated bearing is provided at a position where the bore is formed. The support housing 601 rotatably supports the rotation axis 611*a* of the fixing roller 611.

A bearing member 605 which is rotatable with respect to the rotation axis 611*a* is mounted on a portion of the rotation axis 611*a* of the fixing roller 611, the portion being arranged so as to project toward the outer side from the support housing 601. The bearing member 605 as an example of a positioning member is used for an operation to attach or detach the belt unit 600 and positioning of the belt unit 600 with respect to the image forming apparatus 1.

Furthermore, a holding pin 606 which projects toward the front side in FIG. 3 is attached to the support housing 601 on the inner heating roller 612 side thereof. The holding pin 606 as an example of a second positioning member is used for an operation to attach or detach the belt unit 600 and positioning of the belt unit 600 with respect to the image forming apparatus 1, as well as the bearing member 605 mentioned above.

Note that the support housing 601 and the roller support member 602 are provided to the fixing roller 611 and the like on each of the front and rear sides in FIG. 3. The slide support member 603, the roller biasing member 604, the bearing member 605 and the holding pin 606 are also provided on each of the front and rear sides in FIG. 3, respectively.

Additionally, a gear (not shown) for receiving driving force from the driving motor (not shown) provided on the main body of the image forming apparatus 1 is attached to the rotation axis 611*a* of the fixing roller 611 projecting toward the rear side in FIG. 3.

<Explanation of Mounting Structure of Belt Unit on Image Forming Apparatus>

Next, a mounting structure of the belt unit 600 on the image forming apparatus 1 is described.

Figure 4:
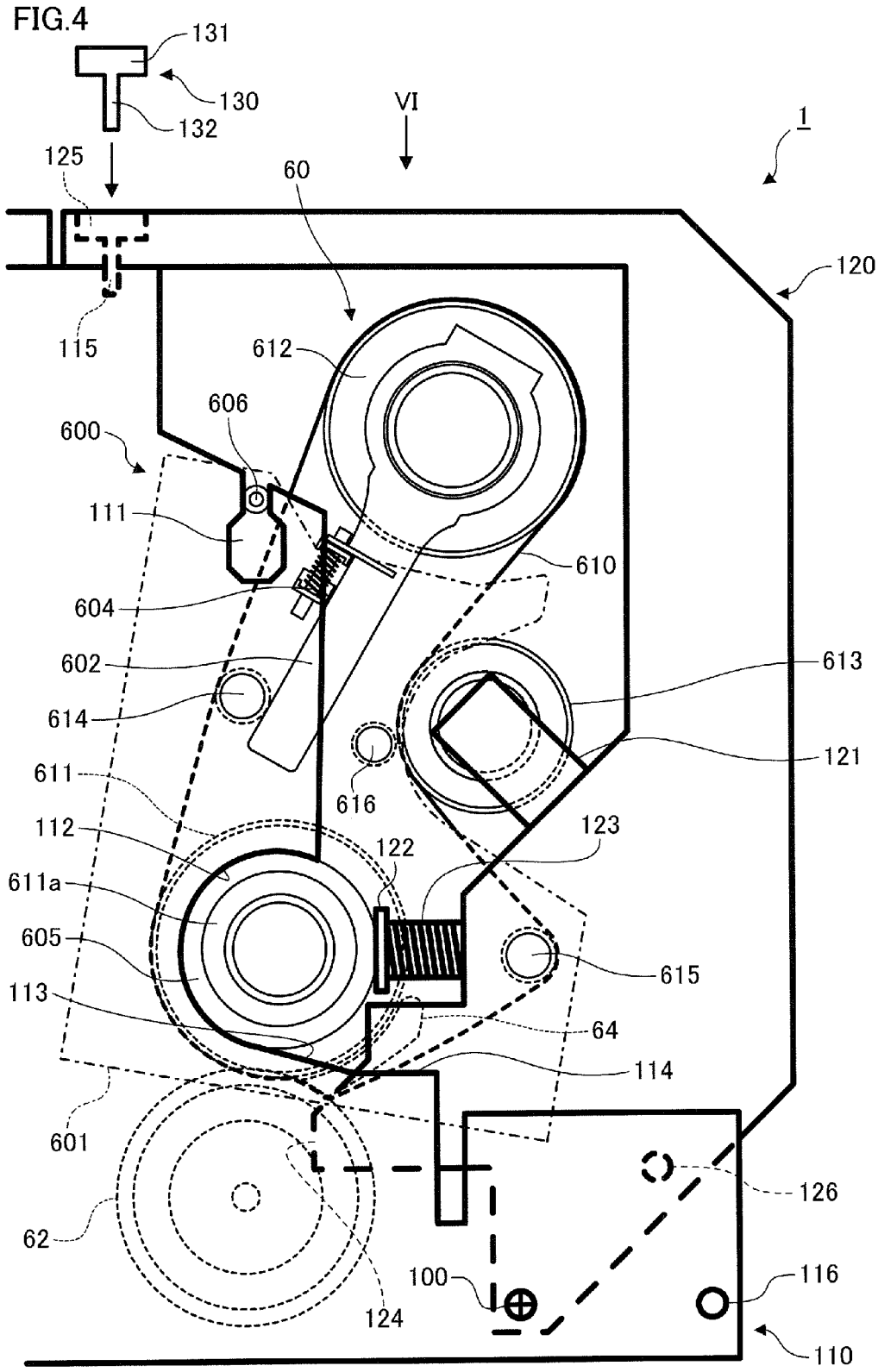
FIG. 4 is a diagram for illustrating a state in which the belt unit is mounted and positioned on the image forming apparatus.

FIG. 4 is a diagram for illustrating a state in which the belt unit 600 is mounted and positioned on the image forming apparatus 1.

Figure 5:
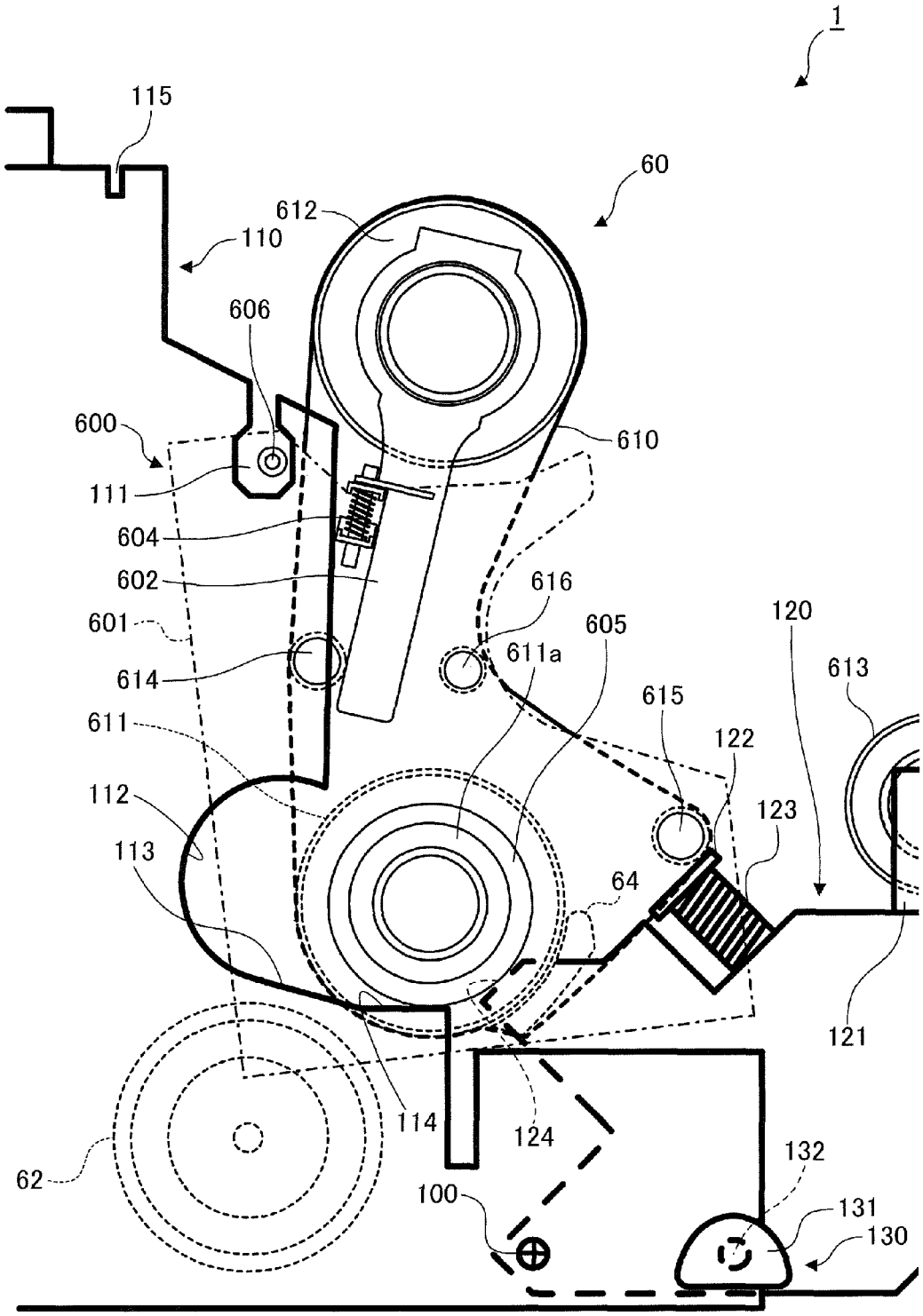
FIG. 5 is a diagram for illustrating a state in which the belt unit is exposed in the image forming apparatus in order to replace the belt unit.

FIG. 5 is a diagram for illustrating a state in which the belt unit 600 is exposed in the image forming apparatus 1 in order to replace the belt unit.

Figure 6:
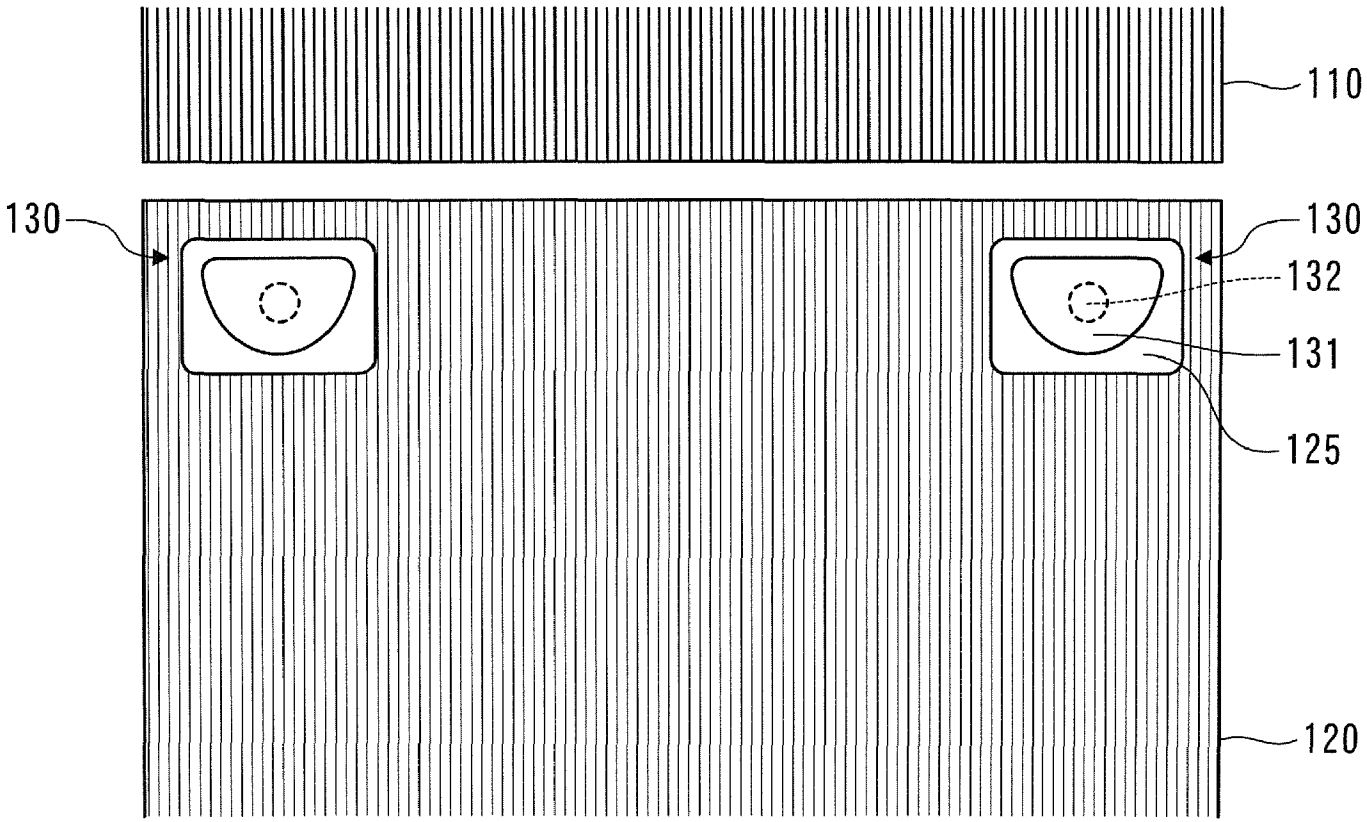
FIG. 6 is a top view of FIG. 4 seen from a VI direction.

Further, FIG. 6 is a top view of FIG. 4 seen form a VI direction.

The image forming apparatus 1 of the present exemplary embodiment includes: a main body housing 110 which is mounted on the image forming apparatus 1 in a fixed state, and rotatably supports the pressure roller 62 constituting the fixing unit 60; a movable housing 120 which is attached to the main body housing 110 so as to be openable and closeable. Here, the main body housing 110 as an example of a first housing and the movable housing 120 as an example of a second housing are rotatably connected with each other by an axis 100 provided below. Additionally, the main body housing 110 and the movable housing 120 are connected with each other by an unillustrated spring above the axis 100. This unillustrated spring restrains the movable housing 120 from rotating in the clockwise direction in FIG. 4 around the axis 100 with respect to the main body housing 110. Rotation of the movable housing 120 in the clockwise direction in FIG. 4 around the axis 100 with respect to the main body housing 110 exposes the belt unit 600 to the outside. Meanwhile, rotation of the movable housing 120 in the counterclockwise direction in FIG. 4 around the axis 100 with respect to the main body housing 110 covers the belt unit 600 from the outside.

The main body housing 110 is formed of two side plates connected with a member extending from the front side to the rear side in FIG. 4. Here, the two side plates are obtained by performing a mechanical process on a metal plate, for example, and are respectively provided on the front side and the rear side of a mounting portion of the belt unit 600.

The main body housing 110 is provided with a pin receiving portion 111 which opens upward and is used for inserting the holding pin 606 attached to the support housing 601 of the belt unit 600. The pin receiving portion 111 as an example of a receiving portion is formed in such a way that the pin receiving portion 111 has a slightly larger diameter than that of the holding pin 606 in an upper region which is an entrance/exit of the holding pin 606, and has a larger diameter in a lower region than in the upper region.

Additionally, the main body housing 110 is provided with a bearing fitted portion 112 which opens toward a lateral side facing the movable housing 120, and into which the bearing member 605 of the belt unit 600 is fitted. The bearing fitted portion 112 as an example of a concave portion has a semicircular opening shape along the bearing member 605. The bearing fitted portion 112 is provided with, at the lower end portion thereof: a sloping portion 113 formed in such a way that an edge thereof is lowered with a slope toward the movable housing 120; and a flat portion 114 which is connected to the sloping portion 113 and has a flat edge.

Further, the main body housing 110 includes: a first fixed opening 115 provided at the upside thereof in the up-and-down direction; and a second fixed opening 116 provided at a position that is horizontal with the axis 100 on a distal side seen from the pressure roller 62 with respect to a position where the axis 100 is formed.

On the other hand, the movable housing 120 is formed of a material obtained by resin molding or the like, for example, and has an L-shaped cross section.

The movable housing 120 is provided with a support portion 121 which rotatably supports the outer heating roller 613 constituting the fixing unit 60. This configuration allows the outer heating roller 613 to rotate around the axis 100 in accordance with the movable housing 120.

Additionally, the movable housing 120 includes a pressing member 122 attached thereto. As shown in FIG. 4, the pressing member 122 presses the bearing member 605 against an edge of the inner heating roller 612 by pressing the bearing member 605 fitted into the bearing fitted portion 112 of the main body housing 110 toward the main body housing 110 from a lateral side of the bearing member 605, when the movable housing 120 is closed with respect to the main body housing 110 in a state where the belt unit 600 is arranged. The pressing member 122 as an example of a second pressing member is attached to the movable housing 120 through a spring 123 as an example of an elastic member, so as to be capable of advancing and retracting with respect to the movable housing 120.

Further, the movable housing 120 includes a regulation portion 124 formed therein. As shown in FIG. 5, the regulation portion 124 regulates further movement of the bearing member 605 by coming into contact with the bearing member 605, when the movable housing 120 is opened with respect to the main body housing 110 in the state where the belt unit 600 is arranged, and the bearing member 605 is removed from the bearing fitted portion 112 provided to the main body housing 110. The regulation portion 124 has a structure in which two flat surfaces are connected with each other by one sloping surface. The height of a flat surface at a portion of the regulation portion 124 adjacent to the pressing member 122 is the same as that of a surface of the pressing member 122. Moreover, the regulation portion 124 functions as a first pressing member which presses the bearing member 605 toward the bearing fitted portion 112, as will be described later.

Furthermore, the movable housing 120 includes: a first movable opening 125 provided on an upper edge thereof; and a second movable opening 126 provided on a lower edge thereof.

In the present exemplary embodiment, the first fixed opening 115 provided to the main body housing 110 and the first movable opening 125 provided to the movable housing 120 overlap each other when the movable housing 120 is closed with respect to the main body housing 110, as shown in FIG. 4.

On the other hand, in the present exemplary embodiment, the second fixed opening 116 provided to the main body housing 110 and the second movable opening 126 provided to the movable housing 120 overlap each other when the movable housing 120 is opened with respect to the main body housing 110, as shown in FIG. 5.

The image forming apparatus 1 further includes fastening members 130. The fastening members 130 fasten the movable housing 120 to the main body housing 110 by penetrating the first fixed opening 115 and the first movable opening 125, which are overlapped each other, when the movable housing 120 is closed with respect to the main body housing 110, as shown in FIGS. 4 and 6, for example. Additionally, the fastening members 130 fasten the movable housing 120 to the main body housing 110 by penetrating the second fixed opening 116 and the second movable opening 126, which are overlapped each other, when the movable housing 120 is opened with respect to the main body housing 110, as shown in FIG. 5, for example. Each of the fastening members 130 includes: a grip portion 131 for a user to hold by hand; and a fastening pin 132 which is attached to the grip portion 131 and is capable of being inserted into each of the aforementioned openings.

<Explanation of Procedure Removing Belt Unit from Image Forming Apparatus>

Next, a procedure removing the belt unit 600 from the image forming apparatus 1 is described with reference to FIGS. 4 to 6. Here, the image forming apparatus 1 is supposed to be as shown in FIG. 4 in an initial state. When the belt unit 600 gets removed from the image forming apparatus 1, an opening operation to open the movable housing 120 closed with respect to the main body housing 110 is performed.

First, the fastening members 130 which fasten the movable housing 120 to the main body housing 110 are removed from above. This causes the movable housing 120 to be rotatable around the axis 100 with respect to the main body housing 110. However, removal of the fastening members 130 does not release the movable housing 120 with respect to the main body housing 110 because the movable housing 120 is pulled toward the main body housing 110 by the unillustrated spring connected between the main body housing 110 and the movable housing 120.

Next, when force in the clockwise direction in the figures around the axis 100 is applied to the movable housing 120 through the first movable opening 125, for example, the movable housing 120 starts rotating in the clockwise direction in the figures while resisting the pulling force of the unillustrated spring.

Along with rotation of the movable housing 120 in the clockwise direction in the figures, the pressing member 122 provided to the movable housing 120 moves in a direction apart from the bearing member 605 provided to the belt unit 600 held in the main body housing 110. Additionally, the outer heating roller 613 attached to the support portion 121 provided to the movable housing 120 also separates from the fixing belt 610 provided to the belt unit 600. As a consequence, in the belt unit 600, the bearing member 605 is pressed on an upper edge of the bearing fitted portion 112 by the pressure roller 62, while the holding pin 606 is held on the main body housing 110 side in a state where the holding pin 606 is loosely fitted into the pin receiving portion 111.

After that, when the movable housing 120 is further rotated in the clockwise direction in the figures with respect to the main body housing 110, the second movable opening 126 provided to the movable housing 120 reaches a position at which the second movable opening 126 overlaps with the second fixed opening 116 provided to the main body housing 110. In this state, the fastening members 130, which are previously removed, are prepared and inserted from a lateral side so that the fastening pin 132 of each fastening member 130 penetrates the second fixed opening 116 and the second movable opening 126. Thereby, the movable housing 120 is fastened in an opened state with respect to the main body housing 110 while resisting the pulling force of the unillustrated spring. That is, the state of the main body housing 110 and the movable housing 120 changes to that shown in FIG. 5. Additionally, the belt unit 600 is exposed between the main body housing 110 and the movable housing 120 in accordance with this change.

Next, when force toward the movable housing 120 is applied to the fixing roller 611 side (lower side) of the belt unit 600, the bearing member 605 provided to the belt unit 600 starts moving toward a side (right side in FIG. 5) being apart from the bearing fitted portion 112 of the main body housing 110. In this event, after being separated from the bearing fitted portion 112, the bearing member 605 slides down along the sloping portion 113 of the main body housing 110 due to the gravity applied to the belt unit 600. The bearing member 605 having slid down along the sloping portion 113 then bumps into the flat portion 114 of the main body housing 110 at a part of the peripheral surface of the bearing member 605, and stops by another part of the peripheral surface thereof bumping into the regulation portion 124 of the movable housing 120. At this time, on the inner heating roller 612 side (upper side) of the belt unit 600, the holding pin 606 is loosely fitted into the pin receiving portion 111 provided to the main body housing 110. Accordingly, in accordance with the aforementioned slide down of the bearing member 605 along the sloping portion 113, the holding pin 606 moves downward in a state where the holding pin 606 is restrained from moving in the lateral direction thereof by the pin receiving portion 111. That is, as a whole, the belt unit 600 rotates in the counterclockwise direction in the figures with the holding pin 606 as an axis, while the holding pin 606 itself moves downward. As a result, the state of the belt unit 600 changes to that shown in FIG. 5.

In this state, the belt unit 600 is pulled upward from the upper side in FIG. 5. At this time, the bearing member 605 provided to the belt unit 600 is apart from the bearing fitted portion 112 of the main body housing 110. Additionally, the pin receiving portion 111 of the main body housing 110 does not restrain the holding pin 606 provided to the belt unit 600 from moving upward. Thus, the belt unit 600 is allowed to be removed from the image forming apparatus 1.

<Explanation of Procedure Mounting Belt Unit on Image Forming Apparatus>

Next, a procedure mounting the belt unit 600 on the image forming apparatus 1 is described with reference to FIGS. 4 to 6. Here, the image forming apparatus 1 is supposed to be as shown in FIG. 5 and to have the belt unit 600 removed in an initial state. When the belt unit 600 gets mounted on the image forming apparatus 1, a closing operation to close the movable housing 120 opened with respect to the main body housing 110 is performed.

First, the belt unit 600 is inserted downward from the upper side in FIG. 5 into an opening portion formed by the main body housing 110 and the movable housing 120. In this event, the holding pin 606 provided on the inner heating roller 612 side (upper side) of the belt unit 600 is inserted from upward into the pin receiving portion 111 provided to the main body housing 110. Meanwhile, on the fixing roller 611 side (lower side) of the belt unit 600, the bearing member 605 bumps into the flat portion 114 of the main body housing 110 at a part of the peripheral surface of the bearing member 605, and stops after moving to a position where another part of the peripheral surface of the bearing member 605 bumps into the regulation portion 124 of the movable housing 120.

Next, the fastening members 130 which fasten the movable housing 120 to the main body housing 110 are removed from the lateral side. This causes the movable housing 120 to be rotatable around the axis 100 with respect to the main body housing 110. Here, the movable housing 120 attempts to move in a direction (in the counterclockwise direction in the figures) in which the movable housing 120 is closed with respect to the main body housing 110 because the movable housing 120 is pulled toward the main body housing 110 by the unillustrated spring connected between the main body housing 110 and the movable housing 120.

The regulation portion 124 attached to the movable housing 120 then presses the bearing member 605 provided to the belt unit 600 toward the bearing fitted portion 112 provided to the main body housing 110 with the force received from the unillustrated spring. Along with this, the bearing member 605 of the belt unit 600 moves while sliding on the flat portion 114 and the sloping portion 113, which are provided to the main body housing 110. Accordingly, the belt unit 600 on the fixing roller 611 side moves toward the main body housing 110.

Thereafter, when force in the counterclockwise direction in the figures around the axis 100 is applied to the movable housing 120, the movable housing 120 further rotates in the counterclockwise direction in the figures. Then, instead of the regulation portion 124, the pressing member 122 bumps into the bearing member 605 of the belt unit 600, in accordance with the rotation of the movable housing 120. Along with this, the bearing member 605 of the belt unit 600 rises on the sloping portion 113 while being pressed by the spring 123 and the pressing member 122, thereby to be fitted into the bearing fitted portion 112.

In this event, in the belt unit 600, the fixing belt 610 on a side coming into contact with the peeling pad 64 first bumps into the pressure roller 62, and the bearing member 605 engages with the bearing fitted portion 112 of the main body housing 110. Further, the fixing belt 610 on a side coming into contact with the fixing roller 611 bumps into the pressure roller 62. At this time, on the inner heating roller 612 side (upper side) of the belt unit 600, the holding pin 606 is loosely fitted into the pin receiving portion 111 provided to the main body housing 110. Accordingly, in accordance with the aforementioned slide up of the bearing member 605 along the sloping portion 113, the holding pin 606 moves upward in the state where the holding pin 606 is restrained from moving in the lateral direction thereof by the pin receiving portion 111. That is, as a whole, the belt unit 600 rotates in the clockwise direction in the figures with the holding pin 606 as an axis, while the holding pin 606 itself moves upward.

Additionally, along with rotation of the movable housing 120 in the counterclockwise direction in the figures, the outer heating roller 613 attached to the support portion 121 provided to the movable housing 120 comes into contact with the fixing belt 610 provided to the belt unit 600.

After that, when the movable housing 120 is further rotated in the counterclockwise direction in the figures, the movable housing 120 gets closed with respect to the main body housing 110. At this time, the bearing member 605 provided to the belt unit 600 is pressed by the pressing member 122 provided to the movable housing 120, thereby to get fitted into the bearing fitted portion 112 of the main body housing 110. Additionally, when the movable housing 120 is closed with respect to the main body housing 110, the first movable opening 125 provided to the movable housing 120 reaches a position at which the first movable opening 125 overlaps with the first fixed opening 115 provided to the main body housing 110. In this state, the fastening members 130, which are previously removed, are prepared and inserted from the upper side so that the fastening pin 132 of each fastening member 130 penetrates the first fixed opening 115 and the first movable opening 125. Thereby, the movable housing 120 is fastened in a closed state with respect to the main body housing 110. Moreover, along with this, positioning of the belt unit 600 with respect to the pressure roller 62 provided to the main body housing 110 and positioning of the outer heating roller 613 provided to the movable housing 120 with respect to the belt unit 600 are performed by the main body housing 110 and the movable housing 120. That is, the state of the belt unit 600, the pressure roller 62 and the outer heating roller 613 changes to that shown in FIG. 4, thereby to form the fixing unit 60.

Here, as shown in FIG. 4, the fixing roller 611 provided to the belt unit 600 receives force from the pressure roller 62 in a direction extending from the rotation center of the pressure roller 62 to that of the fixing roller 611, in a state where the belt unit 600 is attached to the image forming apparatus 1. The bearing member 605 provided at each of the ends in the axial direction of the fixing roller 611 is fitted into the bearing fitted portion 112 provided to the main body housing 110. The bearing fitted portion 112 is formed so as to extend to a position where the bearing fitted portion 112 faces a direction in which the fixing roller 611 receives force from the pressure roller 62. This configuration causes the force which the fixing roller 611 receives from the pressure roller 62 not to separate the bearing member 605 from the main body housing 110.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt unit that includes:

a first roller member;

a second roller member provided above the first roller member;

a belt member rotating while being laid around the first roller member and the second roller member; and a positioning member rotatably holding the first roller member and being used for positioning of the first roller member;

a pressure member that is provided below the first roller member and comes into pressure-contact with an outer peripheral surface of the belt member at a position where the pressure member faces the first roller member, thereby to form a fixing pressure portion between the pressure member and the belt member, the fixing pressure portion allowing a recording medium carrying an unfixed toner image to pass therethrough;

a first housing that includes a concave portion and a sloping portion formed therein and supports the positioning member, the concave portion opening toward a lateral direction, the sloping portion sloping downward from an edge portion of a lower side of the concave portion; and a second housing that presses the positioning member so that the positioning member is fitted into the concave portion, in accordance with a closing operation to move in a direction in which the second housing is closed with respect to the first housing.

2. The fixing device according to claim 1, further comprising:

a second positioning member provided above the positioning member in the belt unit; and a receiving portion that is provided above the concave portion in the first housing and receives the second positioning member so as to allow the second positioning member to move in an up-and-down direction.

3. The fixing device according to claim 2, further comprising:

a first pressing member that is provided to the second housing and presses the positioning member toward the concave portion, in accordance with the closing operation of the second housing with respect to the first housing; and a second pressing member that is attached to the second housing through an elastic member and presses the positioning member toward the concave portion instead of the first pressing member, in accordance with the further closing operation of the second housing with respect to the first housing.

4. The fixing device according to claim 3, wherein an edge portion of an upper side of the concave portion extends beyond a position where the first roller member receives force from the pressure member when the positioning member is fitted into the concave portion.

5. The fixing device according to claim 2, wherein an edge portion of an upper side of the concave portion extends beyond a position where the first roller member receives force from the pressure member when the positioning member is fitted into the concave portion.

6. The fixing device according to claim 1, further comprising:

a first pressing member that is provided to the second housing and presses the positioning member toward the concave portion, in accordance with the closing operation of the second housing with respect to the first housing; and a second pressing member that is attached to the second housing through an elastic member and presses the positioning member toward the concave portion instead of the first pressing member, in accordance with the further closing operation of the second housing with respect to the first housing.

7. The fixing device according to claim 6, wherein an edge portion of an upper side of the concave portion extends beyond a position where the first roller member receives force from the pressure member when the positioning member is fitted into the concave portion.

8. The fixing device according to claim 1, wherein an edge portion of an upper side of the concave portion extends beyond a position where the first roller member receives force from the pressure member when the positioning member is fitted into the concave portion.

9. The fixing device according to claim 1, further comprising:

a heat source that is included at least one of the first roller member and the second roller member and heats the belt member through the one of the first roller member and the second roller member; and an outer heating member that is arranged so as to come into contact with the outer peripheral surface of the belt member and heats the belt member from outside thereof, wherein the outer heating member is attached to the second housing and separates from the belt member in accordance with an opening operation of the second housing.

10. An image forming apparatus comprising:

a toner image forming unit that forms an unfixed toner image on a recording medium;

a fixing unit that includes:

a belt unit that includes:

a first roller member;

a second roller member provided above the first roller member;

a belt member rotating while being laid around the first roller member and the second roller member; and a positioning member rotatably holding the first roller member and being used for positioning of the first roller member; and a pressure member that is provided below the first roller member and comes into pressure-contact with an outer peripheral surface of the belt member at a position where the pressure member faces the first roller member, thereby to form a fixing pressure portion between the pressure member and the belt member, the fixing pressure portion allowing the recording medium carrying the unfixed toner image to pass therethrough;

a first housing that includes a concave portion and a sloping portion formed therein and supports the positioning member, the concave portion opening toward a lateral direction, the sloping portion sloping downward from an edge portion of a lower side of the concave portion; and a second housing that presses the positioning member so that the positioning member is fitted into the concave portion, in accordance with a closing operation to move in a direction in which the second housing is closed with respect to the first housing.

11. An image forming apparatus comprising:

a belt unit that includes:

a first roller member;

a second roller member;

a belt member rotating while being laid around the first roller member and the second roller member; and a positioning member rotatably holding the first roller member and being used for positioning of the first roller member;

a first housing that includes a concave portion opening toward a lateral direction and supports the positioning member; and a second housing that presses the positioning member so that the positioning member is fitted into the concave portion, in accordance with a closing operation to move in a direction in which the second housing is closed with respect to the first housing.

* * * * *